United States Patent [19]

Sitek et al.

[11] 3,936,587

[45] Feb. 3, 1976

[54] ELECTRODE CONSTRUCTION FOR RESISTANCE HEATING FURNACE

[75] Inventors: George J. Sitek, Stevensville; Robert N. Revesz; Charles W. Berk, both of St. Joseph, all of Mich.

[73] Assignee: Leco Corporation, St. Joseph, Mich.

[22] Filed: June 28, 1974

[21] Appl. No.: 484,453

[52] U.S. Cl. ..... 13/23; 219/426

[51] Int. Cl.[2] ..... F27D 11/02; H05B 3/08

[58] Field of Search ..... 13/20, 22, 23, 25; 219/426, 427; 73/19

[56] References Cited

UNITED STATES PATENTS

| | | | |
|---|---|---|---|
| 1,023,309 | 4/1912 | Helberger | 219/427 |
| 3,619,839 | 11/1971 | Kraus et al. | 13/20 |
| 3,636,229 | 1/1972 | Sitek | 13/25 |

*Primary Examiner*—R. N. Envall, Jr.
*Attorney, Agent, or Firm*—Price, Heneveld, Huizenga & Cooper

[57] ABSTRACT

A resistance heating furnace employs a pair of spaced electrodes, one of which is movable to clamp a resistive crucible between the electrodes for passing current therethrough for heating a specimen positioned in the crucible to fuse the specimen. A passageway is provided through one of the electrodes to permit an inert carrier gas to remove gases from the crucible for subsequent analysis. The electrode construction includes a relatively highly conductive base material electrically coupled to a power source for actuating the electrodes and inserts coupled to the surfaces of the electrodes which engage the resistive crucible. The insert material has a relatively high melting point and hardness and a relatively high thermal and electrical conductivity to increase the heating of the crucible and improve the durability of the electrodes. At least one of the electrodes is movable and actuated by a fluid cylinder for clamping the crucible between the electrodes at a constant pressure regardless of the crucible length.

19 Claims, 6 Drawing Figures

ELECTRODE CONSTRUCTION FOR RESISTANCE HEATING FURNACE

BACKGROUND OF THE INVENTION

The present invention relates to resistive furnaces of the type employed for heating a sample positioned in a resistive crucible held between a pair of electrodes.

In resistive furnaces of the type commercially available from Leco Corporation of St. Joseph, Michigan, as part of an analyzing instrument Model No. 760-200, a pair of opposed electrodes is provided between which there is positioned an electrically resistive graphite crucible into which a specimen to be analyzed is inserted. One of the electrodes is moved by means of a spring-loaded arm which clamps the graphite crucible between the copper electrodes whereupon an electrical current is passed through the resistive crucible to raise the crucible temperature to approximately 2500° Centigrade thereby fusing the sample. A passage is provided for a carrier gas such as helium used for sweeping the gases from the crucible to an analyzer to determine, for example, the nitrogen or oxygen content of the specimen as carbon monoxide.

In such apparatus, samples of approximately 0.1–1.5 grams are employed and frequently a flux is employed to facilitate the fusion of the sample. Due to the inherent limitations of the melting point of the copper electrodes previously employed, the required time for analysis for the maximum current (either A.C. or D.C.) employed can be relatively lengthy and in the order of several seconds.

In order to more efficiently utilize such a furnace, several improvements have been made, one of which is represented by U.S. Pat. No. 3,636,229 issued Jan. 18, 1972 to the present assignee. This patent discloses an improved crucible construction to more effectively heat the specimen contained therein. Even with such crucible construction, however, the copper electrode construction inherently limits the speed of operation as well as the temperature which can be reached by the furnace. Also, the relatively soft copper electrodes tend to wear, particularly since even though they are water-cooled, the tips engaging the crucible tend to melt. If the tips get too hot, they react, tending to cause erroneous readings for the specimen being tested.

Additionally, with the spring-actuated electrodes, when variations in fabricated crucible lengths are employed, frequently the contact resistance and contact between the electrode and the crucible varies significantly with different clamping pressures tending to affect the reproducibility of the furnace operation during successive cycles of operation with differet samples. Also, with continued use, the spring constant tends to vary somewhat, further affecting the furnace operation. Finally, the copper electrodes tend to wear and deform, further affecting the reproducibility and furnace performance.

SUMMARY OF THE INVENTION

These shortcomings of the existing furnace are overcome by the improved electrode construction of the present system whereby the copper electrodes are tipped with a high melting point, relatively hard insert material having a relatively high thermal and electrical conductivity such that the electrodes resist melting and reacting and their life is increased. The lower electrode tip defines an annular contact surface with the crucible bottom to efficiently heat the floor of the crucible for fusion of the specimen therein. Tungsten and a tungsten-copper pressed mixture have been successfully employed in the preferred embodiment as the insert materials which are bonded to the ends of the copper electrodes. With such construction, temperatures in the range of 3600° Centigrade are possible which speed the operation of the furnace, and permit the use of larger specimens and in some analytical situations, reduce the need for fluxing agents.

In some embodiments of the present invention, an electrode closure system utilizes a fluid-actuated cylinder coupled to one of the electrodes for clamping the crucible between the electrodes with a constant selectable pressure which is reproducible and which automatically compensates for different crucible heights and different tolerances of fabricated crucible heights. Such construction, when combined with the configurated tipped electrodes, provides a system which significantly reduces the operating time of the furnace, permits its use with specimens having higher fusion temperatures and increases the capability of handling high sample loads. Also, different size crucibles can be employed.

It is an object of the present invention, therefore, to provide a resistance heating furnace with an improved tipped electrode construction.

A further object of the present invention is to provide electrodes for a resistance furnace which are tipped with a relatively high melting point material of relatively high thermal and electrical conductivity that does not getter the gas being measured.

Still a further object of the present invention is to provide a resistance heating furnace with improved means for actuating at least one electrode for clamping a crucible between the electrodes.

Another object of this invention is to provide an electrode construction which cooperates with a crucible to provide an annular contact therebetween for efficient heating of the crucible floor.

These and other objects of the present invention will become apparent upon reading the following description thereof together with the accompanying drawings in which:

DETAILED DESCRIPTION OF THE PREFERRED EMBODIMENT

Figure 1:
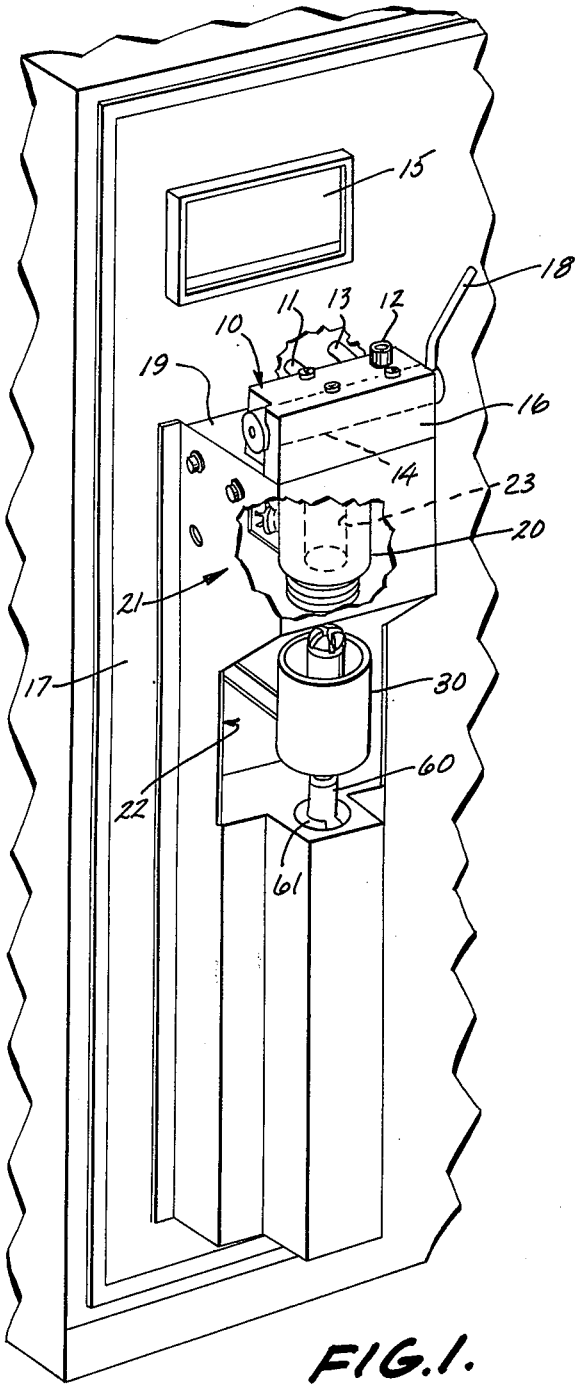
FIG. 1 is a fragmentary perspective view, partly broken away, of the furnace section of a specimen analyzer and embodying the present invention.

Referring now to FIG. 1, there is shown the furnace segment of a combined furnace and analyzer in which there is provided a specimen loading assembly 10 including a specimen receiving port 12 for introducing a solid specimen to a chamber 14 rotatably mounted in the mounting block 16. A lever arm 18 is coupled to an extending end of the chamber 14 for rotating the chamber such that the specimen loaded therein can be dropped through an opening in the chamber into a crucible 50 held between the upper electrode 20 and the lower electrode 40 via an elongated passageway 23 formed through the upper electrode and communicating between the loading assembly and the open top of the crucible when held between the electrodes.

Figure 4:
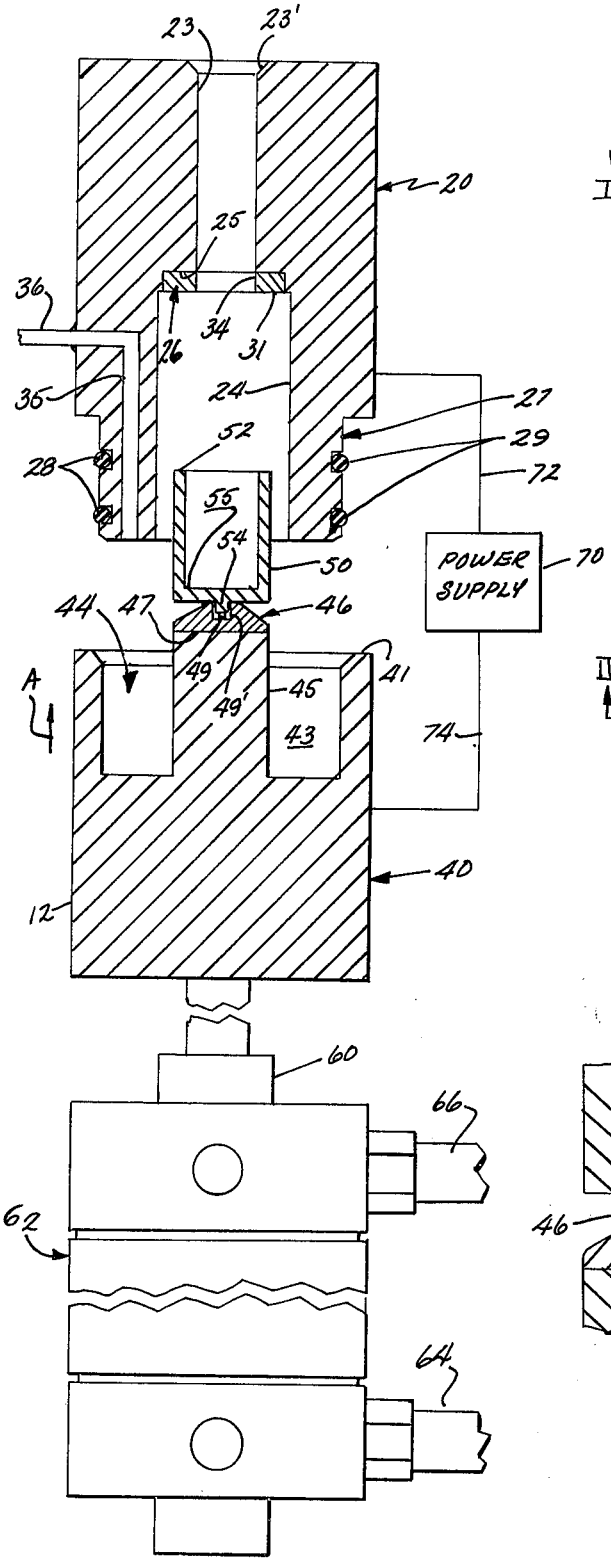
FIG. 4 is a fragmentary view, partly in schematic form and partly in cross section, taken along section lines IV—IV in FIGS. 2 and 3 and showing the upper and lower electrodes and the actuation cylinder coupled to the lower electrode.

The specimen loading assembly includes a pair of gas lines 11 and 13 for introducing a carrier gas such as helium for initially outgassing the crucible and subsequently carrying the specimen gas from the crucible to the analyzer (not shown) through a discharge tube 36 (FIG. 4). In addition, the furnace includes a meter 15 indicating the electrical current flow through the crucible.

In the preferred embodiment of the furnace, the upper electrode is fixed to frame 17 of the furnace by means of a mounting block 19. A shroud 21 encloses the upper electrode assembly as well as the actuation mechanism for the movable lower electrode assembly. The shroud includes a cutaway segment 22 providing access to the lower electrode for insertion and removal of a crucible. The lower electrode 40 is mounted to a movable rod 60 slidably fitted within a sleeve bearing 61 suitably mounted to the furnace frame. Rod 60 is coupled to a fluid-actuated cylinder as described below for moving electrode 40 toward and away from upper electrode 20. Referring now to FIGS. 2–6, the electrode construction and the actuation means therefor are described in detail.

Figure 2:
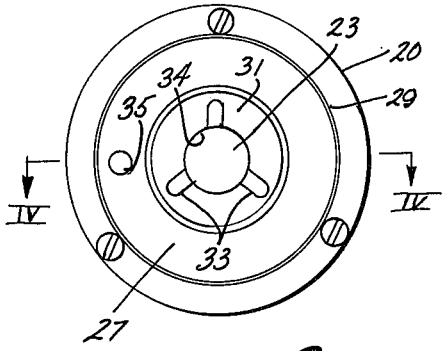
FIG. 2 is an enlarged bottom plan view of the upper electrode for the furnace shown in FIG. 1.

The upper electrode assembly 20 is best shown in FIGS. 2 and 4 and comprises a generally cylindrical electrode body including an elongated central passage 23 extending from a flared opening 23' on the top for receiving a specimen from the loading assembly downwardly to an enlarged cylindrical crucible-receiving chamber 24 at the bottom of the electrode. The interface between passage 23 and chamber 24 defines an annular shoulder 25 to which there is mounted an annular (i.e., washer-shaped) insert 26 made of tungsten or a tungsten-copper mixture. The body of electrode 20 is made of copper and includes suitable passages (not shown) for providing water cooling of the electrode. The lower end of the exterior portion of the upper electrode includes a downwardly projecting cylindrical portion 27 of reduced diameter and includes a pair of vertically spaced annular grooves 28 surrounding projection 27 for receiving sealing O-rings 29 therein.

The electrode structure so formed is adapted to interengage the lower electrode assembly 40 such that when the lower electrode is moved upwardly, as indicated by arrow A (FIG. 4), an annular rim 52 of the graphite crucible 50 will engage the lower surface 31 of insert 26. Insert 26 includes three 120° spaced notches 33 (FIG. 2) extending radially outwardly from the inner edge 34 of the insert outwardly a distance sufficient to extend beyond the crucible rim when the crucible is clamped in position. These notches provide a communication path from the interior of the crucible permitting the specimen gas and carrier gas to exit the crucible and the upper electrode during the fusion of the specimen through a port 35 (FIG. 4) formed through the upper electrode. A discharge tube 36 is coupled to port 35, as seen in FIG. 4, and communicates with the associated analyzer. The inner diameter of insert 26 is approximately 0.41 inch in one embodiment while the outer diameter is 0.87 inch. The insert 26 is approximately 0.065 inch thick and is secured to shoulder 25 by conventional silver soldering.

The lower electrode assembly 40 comprises a cylindrical body 42 also made of copper and including suitable passages (not shown) for water cooling the electrode. Formed downwardly through the electrode from an upper portion is an annular chamber 44 dimensioned to receive the downwardly projecting portion 27 of the upper crucible such that the O-rings 29 sealably engage the outer wall 43 of chamber 44. Chamber 44 is sufficiently deep such that the open mouth of port 35 is spaced from the floor of the chamber and unobstructed when the crucible is clamped between the electrodes.

Figure 3:
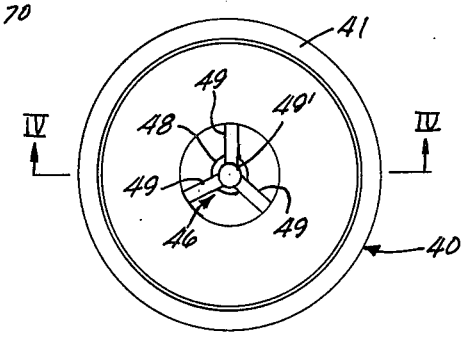
FIG. 3 is an enlarged top plan view of the lower electrode of the furnace shown in FIG. 1.
Figure 5:
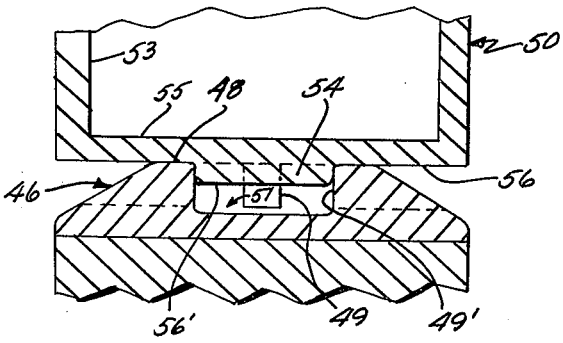
FIG. 5 is a greatly enlarged fragmentary cross section of the lower electrode-crucible interface.

A centrally positioned pedestal 45 extends upwardly from the axis of cylindrical electrode 40 slightly above the inwardly tapered rim 41 of the electrode and includes a tungsten insert 46 seated against the flat top surface 47 of the pedestal. Insert 46, as best seen in FIGS. 3 and 5, has a flattened annular upper surface 48 which seats against the bottom 56 of the crucible. The insert includes a central aperture 49' extending downwardly a distance such that a clearance 51 (FIG. 3) space exists between the bottom 56' of the button-like projection 54 of crucible 50 and the floor of aperture 49' in the insert. Three slots 49 extend radially outwardly from aperture 49' at 120° intervals.

Crucible 50 is made of pure graphite and consists of a cylindrical side wall 53 and an enclosed lower end defining the floor 55 for supporting the specimen to be analyzed. The dimensions and fabrication of crucible 50 are disclosed in a concurrently filed U.S. patent application entitled CRUCIBLE, Ser. No. 484,303 and assigned to the present assignee. The bottom projection 56' is relatively short (i.e., 0.55 inch) and serves only as a centering device for the crucible in cooperation with aperture 49' of the lower electrode tip. Thus, the crucible is supported on the annular surface 48 of tip 46 and not by the floor of aperture 49'. It is believed that the annular electrical contact between the tip 46 and crucible 50 accounts at least in part for the improved performance of the crucible-electrode combination over the previous flat bottom crucible and to some extent over the stud crucible disclosed in the above identified patent. The annular surface 48 is segmented by slots 49 but is significantly continuous and slots 49 may be deleted in some embodiments. The inner diameter annular surface 48 is approximately 0.2 inch while the outer diameter is approximately 0.3 inch.

Insert 46, like insert 26, is made of pure tungsten, tungsten alloy, or a commercially available pressed material comprising a mixture of 75 percent pure tungsten and 25 percent copper. The latter composition is preferred and the insert so formed is mounted to the top of pedestal 45 by conventional silver soldering accomplished by placing a silver solder insert in the shape of the interface between the insert and the electrode, positioning the insert on the silver solder insert, and heating the electrode and insert above the melting point of the silver solder to bond the insert to the electrode. Insert 46 is approximately 0.69 inch in diameter and 0.04 inch thick at the outer edge. At the surface 48, the insert is 0.125 inch thick with notches 49 and recess 49' extending to a maximum depth of 0.085 inch at the center of the insert.

Attached to the lower electrode 40 by conventional means is a push rod 60 coupled to the piston of a double-acting cylinder 62. Cylinder 62 has a first inlet 64 for receiving a pressurized fluid to cause the rod 60 to extend from the cylinder thereby raising the lower electrode in the direction indicated by arrow A at FIG. 4. Cylinder 62 also includes a second inlet 66 for receiving pressurized fluid causing the rod 60 to retract for lowering electrode 40. Cylinder 62 is selected to provide sufficiently long excursion of rod 60 to accommodate all crucible lengths employed with the furnace.

Electrically coupled to each of the electrodes 20 and 40 is a power supply 70 (FIG. 4) having one output conductor 72 electrically coupled to the upper electrode 20 and a second output conductor 74 coupled to the lower electrode 40. When the lower electrode is in its raised position such that the crucible 50 is clamped between inserts 26 and 46 thereby completing the electrical current path, power supply 70 applies electrical current to heat the crucible to cause a sample positioned in the crucible to be reduced in the helium atmosphere of the carrier gas and fuse to release gases such as nitrogen or oxygen contained in the specimen and which are detected by the analyzing instrument coupled to the outlet 36 (FIG. 4) of the furnace. In the preferred embodiment, power supply 70 applies A.C. current to the electrodes.

Figure 6:
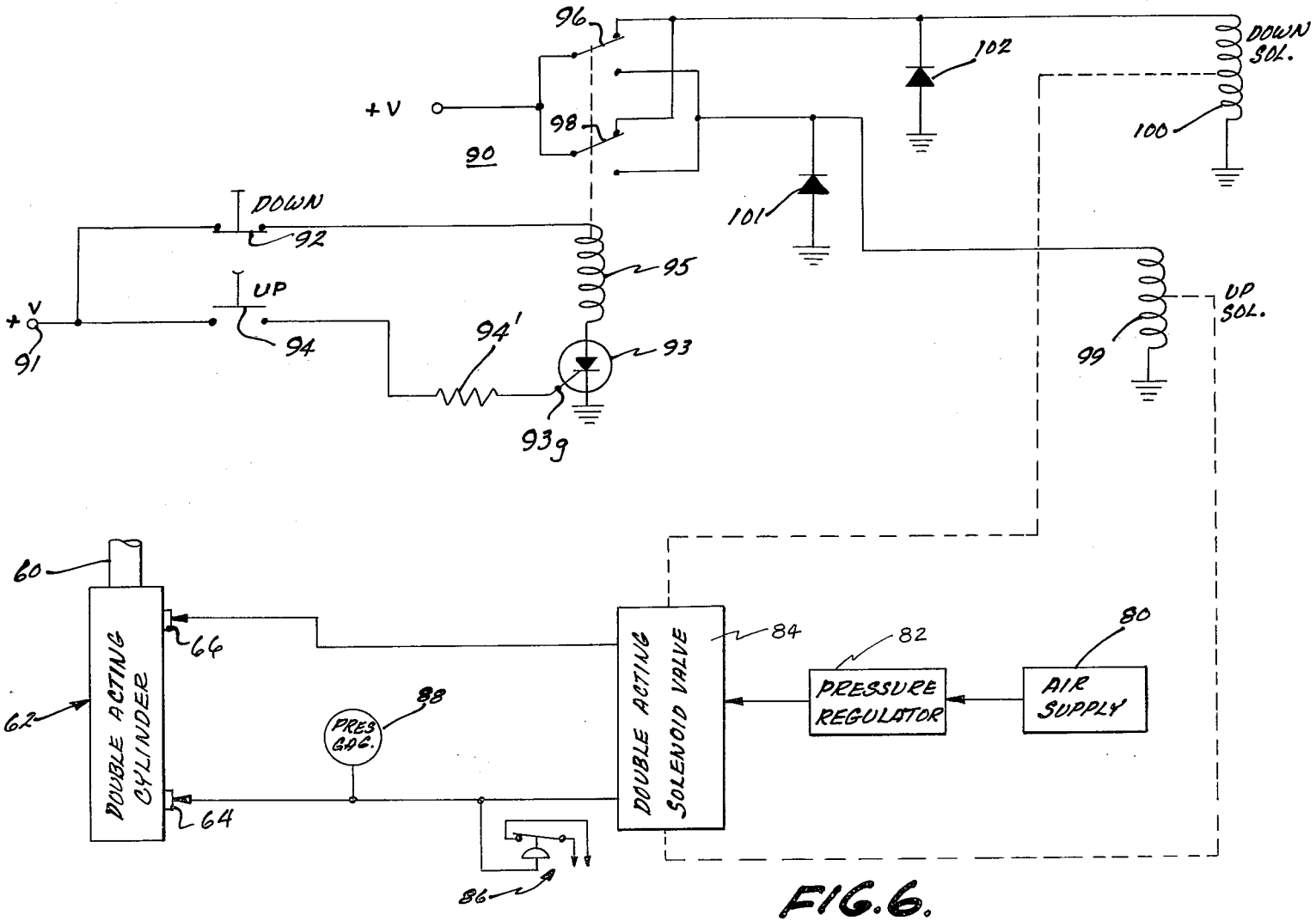
FIG. 6 is a control circuit diagram, partly in schematic and block form, showing the electrical and pneumatic control circuit for actuating the movable lower electrode shown in FIG. 1.

Referring to the electrical and pneumatic diagram of FIG. 6, a description of the control circuit for actuating the movable electrode is now presented. Cylinder 62 is a pneumatic, double-acting cylinder actuated by an air supply 80 through a pressure regulator 82 and double-acting solenoid valve 84. Regulator 82 is adjustable such that the closing pressure of the electrode can be selected to clamp a crucible between the electrodes at a selected pressure. A pressure gauge 88 is coupled to the line between valve 84 and input coupling 64 for monitoring the applied pressure.

Supply 80 is also coupled to the inlet port 66 of cylinder 62 through the solenoid valve 84. A pressure-actuated switch 86 is coupled between valve 84 and inlet 64 to provide an electrical control signal which can be utilized to provide a signal to the analyzer indicating the closed position of the electrodes. Valve 84 is alternately actuated to raise and lower the electrode between a crucible-clamping and crucible-inserting and removal position, respectively, and is controlled by means of the electrical control circuit now described.

The electrical control circuit 90 includes a power supply for supplying a voltage +V at an input terminal 91 which is coupled to a relay coil 95 through a normally closed push button switch 92 and the anode-to-cathode current path of an SCR 93. The cathode of SCR 93 is returned to ground to complete the current path from the voltage supply through coil 95 when the SCR is triggered into conduction. A gate terminal 93g of the SCR is also coupled to the +V supply through a normally open push button switch 94 and a current limiting resistor 94' .

Relay contacts 96 and 98 associated and actuated by relay coil 95 have the movable contact section commonly coupled to the +V supply and are actuated between a first position when coil 95 is energized to couple the +V supply to an electrode-raising solenoid 99 associated with solenoid valve 84. When the SCR is not conductive (i.e., coil 95) is deenergized), contacts 96 and 98 are in a second position (shown in FIG. 6) to couple the +V supply to an electrode-lowering solenoid 100 associated with valve 84. A diode 101 is coupled in parallel across solenoid winding 99 to assure only a positive D.C. voltage will be applied to solenoid winding 99 while a diode 102 is similarly coupled to winding 100 for the same purpose.

In operation, a crucible 50 is positioned on the crucible receiving means of the pedestal 45 of the lower electrode and switch 94 actuated to trigger SCR 93 into conduction thereby energizing coil 95. Switch contacts 96 and 98 thereby move to a position to actuate solenoid 99 in turn actuating valve 84 to apply a selected air pressure to cylinder 62. Electrode 40 then raises the crucible into the crucible-receiving cavity 24 of the upper electrode and seats rim 52 against insert 26. With the crucible in this clamped position, power supply 70 is actuated for a period sufficient to heat the crucible to the normal operating temperature thereby outgassing the crucible prior to insertion of the specimen.

Once the crucible has been outgassed, a specimen previously loaded into assembly 10 is dropped through the central passage 23 of the upper electrode 20 by actuating lever arm 18 thereby introducing the specimen to the crucible. A second heating cycle is then initiated by actuating power supply 70 to cause fusion of the specimen. The carrier gas sweeps the resultant gas from the specimen into the analyzer as described above.

After the second heating period, switch 92 is actuated opening the current path for SCR 93 deenergizing coil 95. Switch contacts 96 and 98 then decouple coil 99 from the +V supply and in turn couple winding 100 to the +V supply. This actuates valve 84 which applies air pressure to cylinder 62 to open the electrodes.

In selecting the insert or tipping material for the copper electrodes, the physical properties which determine the acceptability of the material include its thermal and electrical conductivity, melting temperature, hardness, wetability, machinability and the reactivity, if any, with the specimen gas to be analyzed. It is generally desired to have a relatively high thermal and electrical conductivity and a melting point in excess of the highest temperature reached during the heating cycles. At present, crucible temperatures as high as 3600° Centigrade can be achieved with the improved structure and the usable range extends at least from 2500°–3600° Centigrade.

A coincidental benefit from the use of the tipping insert is that the electrode life is considerably increased since the material employed generally is harder than copper and has a significantly higher melting point. In the preferred embodiment, pure tungsten or tungsten-copper alloy or mixture was used and has been employed successfully in furnaces for use with analyzers detecting various gases including nitrogen and oxygen.

Other materials such as molybdenum, tantalum, or alloys other than tungsten may also be employed as the insert material although for some applications, these materials interfere with the specimen gas and will not be suitable. For example, it has been discovered that molybdenum absorbs both nitrogen and carbon monoxide when heated. Regardless of the insert material employed, the insert is relatively thin as compared with the crucible height.

It will become apparent to those skilled in the art that various modifications to the preferred embodiments disclosed herein can be made. It is possible, for example, that in some applications only the bottom electrode is tipped. Also, the electrode cylinder can be hydraulically actuated. These and other modifications can be made without departing from the spirit or scope of the present invention as defined by the appended claims.

The embodiments of the invention in which an exclusive property or privilege is claimed are defined as follows:

1. For use in a furnace for heating an electrically resistive crucible held between electrodes, improved electrode construction comprising:

a pair of electrodes made of an electrically conductive material, at least one of said electrodes movable toward and away from the remaining electrode for alternately clamping and releasing an electrically resistive specimen-holding crucible between said electrodes; and a thin insert mounted to said at least one electrode to contact said crucible, said insert comprising an electrically conductive material with a melting point exceeding about 2500° Centigrade.

2. The apparatus as defined in claim 1 and further including a fluid-actuated cylinder having a movable rod extending therefrom and coupled to said movable electrode for moving said electrode toward and away from said remaining electrode for clamping said crucible between said electrodes.

3. The apparatus as defined in claim 1 wherein said remaining electrode further includes a thin insert mounted to the surface of said electrode to contact said crucible, said insert made of an electrically conductive material with a melting point exceeding about 2500° Centigrade.

4. The apparatus as defined in claim 1 wherein said electrodes are vertically oriented and said insert is mounted to the lower electrode and includes a substantially annular surface for supporting a crucible thereon.

5. For use in a furnace for heating an electrically resistive crucible held between electrodes, improved electrode construction comprising:

a pair of electrodes made of an electrically conductive material, at least one of said electrodes movable toward and away from the remaining electrode for alternately clamping and releasing an electrically resistive specimen-holding crucible between said electrodes; and a thin insert mounted to said at least one electrode to contact said crucible, said insert comprising and electrically conductive high melting point material made of tungsten.

6. The apparatus as defined in claim 5 wherein said insert comprises a pressed mixture of particulate copper and tungsten.

7. The apparatus as defined in claim 1 wherein said electrodes are mounted in a vertical plane and the lower electrode is movable and includes a pedestal for supporting said crucible thereon and wherein said insert is mounted to the top of said pedestal and includes annular crucible supporting means.

8. The apparatus as defined in claim 7 wherein said insert comprises a generally disc-shaped member having a flattened annular surface and including a circular recess centrally formed therein for receiving a button-like projection extending downwardly from a bottom surface of said crucible.

9. The apparatus as defined in claim 8 wherein the upper electrode includes a passageway formed through said upper electrode and communicating with the interior of a crucible when clamped between said electrodes and defining a generally annular shoulder extending around a lower end of said passageway, and wherein said upper electrode includes an insert comprising an electrically conductive material with a melting point exceeding about 2500° Centigrade, said insert being substantially washer-shaped and mounted to said annular shoulder of said electrode.

10. In a resistance heating furnace for fusing a specimen positioned in a crucible and directing an inert carrier gas into said crucible for sweeping gases therefrom as said specimen is fused during the heating of said crucible, an improved electrode construction comprising:

an upper conductive electrode including a crucible-receiving chamber having an end defining an annular shoulder and including a washer-shaped insert including at least one notch formed therein and extending outwardly from an inner edge of said insert, said insert mounted to said annular shoulder for engaging the rim surrounding an open end of a crucible, said insert being made of an electrically conductive material with a melting point exceeding about 2500° Centigrade, said upper electrode further including a passageway extending therethrough and opening at the center of said insert for supplying an inert gas to said crucible, said upper electrode also including an outlet port communicating with said crucible chamber for transporting gas passing through said notch in said insert outwardly from said electrode;

a lower electrode including an annular chamber formed downwardly therein and an upwardly extending pedestal surrounded by said annular chamber and having an insert mounted thereto, said insert including means for supporting a crucible thereon, said insert made an electrically conductive material with a melting point exceeding about 2500° Centigrade;

means for moving one of said electrodes relative to the other for clamping said crucible between said inserts with said crucible positioned in said crucible-receiving chamber and said annular chamber of said lower chamber surrounding a lower portion of said upper electrode; and sealing means coupled to one of said electrodes to seal said crucible-receiving chamber at the junction of said electrodes when said electrodes are in a crucible-clamping position.

11. In a resistance heating furnace for fusing a specimen positioned in a crucible and directing an inert carrier gas into said crucible for sweeping gases therefrom as said specimen is fused during the heating of said crucible, an improved electrode construction comprising:

an upper conductive electrode including a crucible-receiving chamber having an end defining an annular shoulder and including a washer-shaped insert including at least one notch formed therein and extending outwardly from an inner edge of said insert, said insert mounted to said annular shoulder for engaging the rim surrounding an open end of a crucible, said insert being made of a high melting point and high electrical conductivity material including tungsten, said upper electrode further including a passageway extending therethrough and opening at the center of said insert for supplying an inert gas to said crucible, said upper electrode also including an outlet port communicating with said crucible chamber for transporting gas passing through said notch in said insert outwardly from said electrode;

a lower electrode including an annular chamber formed downwardly therein and an upwardly extending pedestal surrounded by said annular chamber and having an insert mounted thereto, said insert including means for supporting a crucible thereon, said insert made of a high melting point and high electrical conductivity material including tungsten;

means for moving one of said electrodes relative to the other for clamping said crucible between said inserts with said crucible positioned in said crucible-receiving chamber and said annular chamber of said lower chamber surrounding a lower portion of said upper electrode; and sealing means coupled to one of said electrodes to seal said crucible-receiving chamber at the junction of said electrodes when said electrodes are in a crucible-clamping position.

12. The apparatus as defined in claim 11 wherein said inserts comprise a pressed mixture of particulate copper and tungsten.

13. The apparatus as defined in claim 12 wherein the crucible-engaging surface of the insert for said lower electrode defines a substantially annular contact with the bottom of said crucible.

14. The apparatus as defined in claim 10 wherein said upper electrode is fixed and said lower electrode is movable, and wherein said moving means comprises a fluid-actuated cylinder having a movable rod coupled to said lower electrode and fluid supply means coupled to said cylinder for clamping said crucible between said electrodes with a selectable pressure.

15. In copper electrode assemblies for use in a furnace for heating a specimen-holding resistive crucible clamped between said electrodes when a power supply is coupled to said electrode assemblies to pass electrical current throuogh said crucible, the improvement comprising:

thin tipping inserts shaped to cover the surface of the electrodes which contact the crucible, said inserts comprising a electrically conductive material having a melting point greater than 2500° Centigrade.

16. In copper electrode assemblies for use in a furnace for heating a specimen-holding resistive crucible clamped between said electrodes when a power supply is coupled to said electrode assemblies to pass electrical current through said crucible, the improvement comprising:

tipping inserts shaped to cover the surface of the electrodes which contact the crucible, said inserts comprising a material including the metal tungsten having a melting point greater than about 2500° Centigrade.

17. The structure as defined in claim 16 wherein said inserts comprise a pressed mixture of particulate copper and tungsten.

18. The structure as defined in claim 17 wherein said mixture is approximately 25 percent copper and 75 percent tungsten.

19. For use in a furnace for heating an electrically resistive crucible held between electrodes, improved electrode construction comprising: a pair of electrodes of electrically conductive material shaped for engaging a resistive crucible therebetween wherein at least one electrode includes an annular crucible-engaging surface providing substantially annular contact between said electrode and said crucible.

* * * * *